US011143062B2

(12) United States Patent
Sano et al.

(10) Patent No.: US 11,143,062 B2
(45) Date of Patent: Oct. 12, 2021

(54) VALVE OPENING-CLOSING TIMING CONTROL APPARATUS

(71) Applicant: AISIN SEIKI KABUSHIKI KAISHA, Kariya (JP)

(72) Inventors: Hajime Sano, Kariya (JP); Tomoharu Otake, Kariya (JP); Hideomi Iyanaga, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 16/928,269

(22) Filed: Jul. 14, 2020

(65) Prior Publication Data

US 2021/0017884 A1 Jan. 21, 2021

(30) Foreign Application Priority Data

Jul. 18, 2019 (JP) ..... JP2019-133100

(51) Int. Cl.
*F01L 1/344* (2006.01)

(52) U.S. Cl.
CPC ..... *F01L 1/344* (2013.01)

(58) Field of Classification Search
CPC ..... F01L 1/352; F01L 2820/032; F01L 1/344; F16D 3/04; F16H 1/32
USPC ..... 123/90.17, 90.15
See application file for complete search history.

(56) References Cited

U.S. PATENT DOCUMENTS

| | | | | |
|---|---|---|---|---|
| 2007/0163526 | A1* | 7/2007 | Sugiura | F01L 1/352 123/90.17 |
| 2009/0017952 | A1* | 1/2009 | Sugiura | F01L 1/352 475/128 |
| 2019/0292952 | A1 | 9/2019 | Miyachi et al. | |

FOREIGN PATENT DOCUMENTS

| | | | | |
|---|---|---|---|---|
| DE | 102016104292 | A1 | 9/2017 | |
| JP | 2008038886 | A | 2/2008 | |
| JP | 2012189050 | A | 10/2012 | |
| JP | 2016017417 | A | 2/2016 | |
| JP | 2016089743 | A * | 5/2016 | |
| JP | 2016089743 | A | 5/2016 | |
| JP | 2017115601 | A * | 6/2017 | F01L 1/352 |
| JP | 2018017202 | A | 2/2018 | |
| WO | 2018092390 | A1 | 5/2018 | |
| WO | WO-2018092390 | A1 * | 5/2018 | F01L 1/356 |

OTHER PUBLICATIONS

WO-2018092390, May 2018, English Language Machine Translation.*

(Continued)

*Primary Examiner* — Patrick Hamo
*Assistant Examiner* — Wesley G Harris
(74) *Attorney, Agent, or Firm* — Buchanan Ingersoll & Rooney PC

(57) ABSTRACT

A valve opening-closing timing control apparatus includes a phase adjustment mechanism. The phase adjustment mechanism includes an input gear and an elastic member that applies biasing force to the input gear in such a way that the input gear meshes with an output gear. An eccentric member includes one first concave portion along a circumferential direction thereof, being formed on an outer circumferential surface. The elastic member includes a supported portion supported by the first concave portion, and a curved portion and a biasing piece portion that generate biasing force. The elastic member is supported by the first concave portion at two different boundaries in the circumferential direction.

5 Claims, 9 Drawing Sheets

(56) References Cited

OTHER PUBLICATIONS

Extended European Search Report dated Dec. 15, 2020 issued by European Patent Office in corresponding European Patent Application No. 20186145.7 (10 pages).
U.S. Appl. No. 16/928,589, filed Jul. 14, 2020, Hajime Sano.

* cited by examiner

VALVE OPENING-CLOSING TIMING CONTROL APPARATUS

CROSS REFERENCE TO RELATED APPLICATIONS

This application is based on and claims priority under 35 U.S.C. § 119 to Japanese Patent Application 2019-133100, filed on Jul. 18, 2019, the entire content of which is incorporated herein by reference.

TECHNICAL FIELD

This disclosure generally relates to a valve opening-closing timing control apparatus.

BACKGROUND DISCUSSION

JP2012-189050A (Reference 1) describes a valve timing adjustment apparatus (one example of a valve opening-closing timing control apparatus) adjusting a valve timing of a valve that a camshaft opens and closes by transmission of torque from a crankshaft in an internal combustion engine. This valve timing adjustment apparatus includes a first rotor, a second rotor (corresponding to an output gear of the present application), a first planetary gear, a second planetary gear (corresponding to an input gear of the present application), a planetary carrier, and an elastic member. The first rotor forms a first inner gear portion. The second rotor forms a second inner gear portion coaxially with the first inner gear portion. The first planetary gear forms a first outer gear portion being eccentric from the first and second inner gear portions, and performs planetary movement while this first outer gear portion meshes with the first inner gear portion on an eccentric side. The second planetary gear forms a second outer gear portion being eccentric from the first and second inner gear portions toward a side opposite to the first outer gear portion, and performs planetary movement while this second outer gear portion meshes with the second inner gear portion on an eccentric side. The planetary carrier includes an outer circumferential surface being eccentric from the first and second inner gear portions toward the same side as the first outer gear portion, and concentrically supports the first planetary gear by the outer circumferential surface. The elastic member is held at the outer circumferential surface, and biases the second planetary gear toward the eccentric side of the second outer gear portion, and biases the planetary carrier toward the eccentric side of the outer circumferential surface.

In this valve timing adjustment apparatus, holding holes (corresponding to a first concave portion of the present application) for individually holding the elastic member are opened at two different locations on the outer circumferential surface of the planetary carrier in a part including an axial-direction end portion on a side of a camshaft. Each of the two elastic members is a metal leaf spring having a substantially V-shaped cross section, and is sandwiched and held between the relevant holding hole and a center hole of the second planetary gear. The two elastic members support the second planetary gear from an inner circumferential side in such a way as to allow the second planetary gear to perform planetary movement.

In the above-described valve opening-closing timing control apparatus, the elastic members are held in two first concave portions, and thus, it is difficult to adjust balance of biasing force acting on the input gear by the elastic members. When balance of the biasing force is not properly adjusted, a backlash between the input gear and the output gear increases, and abnormal noise occurs. In view of the above, it is desired to provide a valve opening-closing timing control apparatus that can easily reduce noise.

A need thus exists for a valve opening-closing timing control apparatus which is not susceptible to the drawback mentioned above.

SUMMARY

A valve opening-closing timing control apparatus according to this disclosure includes a driving-side rotor, a driven-side rotor, and a phase adjustment mechanism. The driving-side rotor rotates around a rotation axis in synchronization with a crankshaft of an internal combustion engine. The driven-side rotor is arranged coaxially with the rotation axis and on an inner side of the driving-side rotor, and rotates integrally with a camshaft for opening and closing a valve of the internal combustion engine. The phase adjustment mechanism sets a relative rotation phase between the driving-side rotor and the driven-side rotor.

The phase adjustment mechanism includes an output gear, an input gear, a tubular eccentric member, a first bearing, a second bearing, and an elastic member. The output gear is provided at the driven-side rotor in such a way as to be coaxial with the rotation axis. The input gear rotates around an eccentric axis in an orientation parallel to the rotation axis, and is connected to the driving-side rotor. The tubular eccentric member supports the input gear from an inner circumferential side, and allows the input gear to rotate. The first bearing is arranged between an inner circumference of the driven-side rotor and an outer circumference of the eccentric member. The second bearing is arranged between an inner circumference of the input gear and an outer circumference of the eccentric member and on a side farther from the camshaft than the first bearing in a direction along the rotation axis. The elastic member is arranged between an outer circumferential side of the eccentric member and an inner circumferential side of the second bearing and along a circumferential direction of the eccentric member, and applies biasing force to the input gear in such a way as to cause a part of the input gear to mesh with a part of the output gear.

Rotation of the eccentric member causes the eccentric axis to revolve and thereby changes a position where the output gear meshes with the input gear. The eccentric member includes one first concave portion formed on an outer circumferential surface along the circumferential direction. The elastic member includes a supported portion, an elastically deformable portion, and a biasing portion. The supported portion is supported by a bottom surface of the first concave portion. The elastically deformable portion is supported by the supported portion, and generates the biasing force. The biasing portion is supported by the elastically deformable portion, and applies the biasing force to the input gear. The elastic member is accommodated in the first concave portion, and is supported, by the first concave portion, at two different locations in the circumferential direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments of this disclosure are described with reference to the drawings.

[Basic Configuration]

Figure 1:
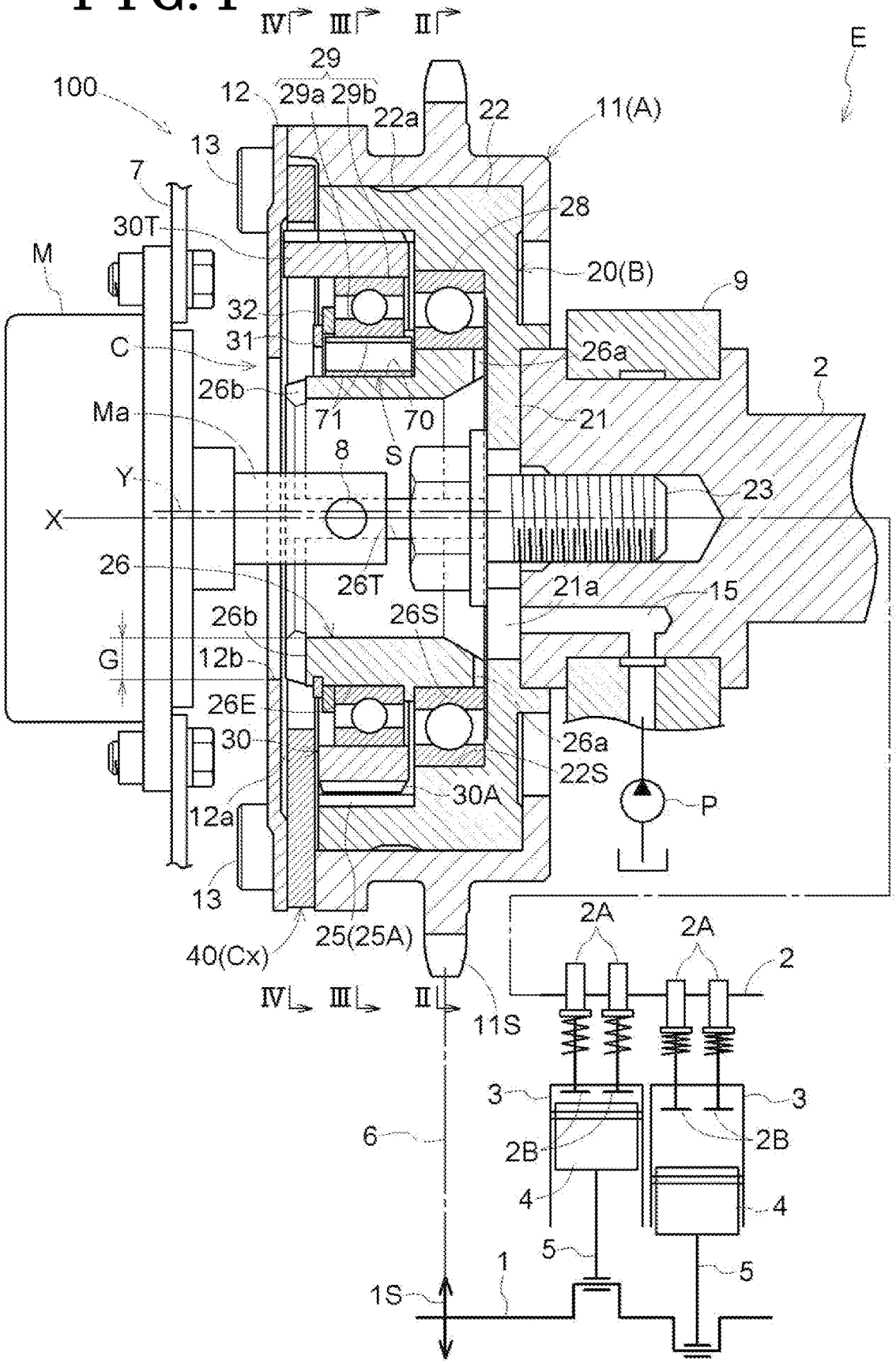
FIG. 1 is a sectional view of a valve opening-closing timing control apparatus.

As illustrated in FIG. 1, a valve opening-closing timing control apparatus 100 according to the present embodiment includes a driving-side rotor A that rotates in synchronization with a crankshaft 1 of an engine E as an internal combustion engine, an intake camshaft 2 (one example of a camshaft) that opens and closes an intake valve 2B (one example of a valve), a driven-side rotor B that rotates integrally with the intake camshaft 2 around a rotation axis X, and a phase adjustment mechanism C that sets a relative rotation phase between the driving-side rotor A and the driven-side rotor B by driving force of a phase control motor M (one example of an electric actuator).

The engine E is configured in a four-cycle type in which pistons 4 are accommodated in a plurality of cylinders 3 formed in a cylinder block, and the pistons 4 are connected to the crankshaft 1 by connecting rods 5. A timing chain 6 (or a timing belt or the like) is wound around an output sprocket 1S of the crankshaft 1 of the engine E and a driving sprocket 11S of the driving-side rotor A.

Thereby, when the engine E is operating, the entire valve opening-closing timing control apparatus 100 rotates around the rotation axis X. Driving force of the phase control motor M causes the phase adjustment mechanism C to operate, and can thereby displace the driven-side rotor B relative to the driving-side rotor A in a direction that is the same as or opposite to the rotating direction. This displacement in the phase adjustment mechanism C sets a relative rotation phase between the driving-side rotor A and the driven-side rotor B, implementing control of timings of opening and closing of the intake valves 2B made by cam portions 2A of the intake camshaft 2.

Operation in which the driven-side rotor B is displaced in the same direction as the rotating direction of the driving-side rotor A is referred to as advance operation, and this advance operation increases an intake compression ratio. Operation in which the driven-side rotor B is displaced in the direction opposite to the rotating direction of the driving-side rotor A (operation in the direction opposite to the advance operation) is referred to as retard operation, and this retarded operation decreases an intake compression ratio.

[Valve Opening-Closing Timing Control Apparatus]

As illustrated in FIG. 1, the driving-side rotor A is configured in such a way as to include an outer case 11 and a front plate 12 fastened to each other with a plurality of fastening bolts 13, a driving sprocket 11S being formed at an outer circumference of the outer case 11. The outer case 11 is a bottomed-tubular-type case including a bottom on which an opening is formed.

As illustrated in FIG. 1 to FIG. 4, an inner space of the outer case 11 accommodates an intermediate member 20 (refer to FIG. 2 and others) as the driven-side rotor B, and the phase adjustment mechanism C (refer to FIG. 3 and others) including a hypotrochoid-type gear reduction mechanism. The phase adjustment mechanism C includes an oldham joint Cx (refer to FIG. 4 and others) by which a phase shift is reflected in the driving-side rotor A and the driven-side rotor B.

The intermediate member 20 constituting the driven-side rotor B includes a support wall portion 21 connected to the intake camshaft 2 in a state where the support wall portion 21 is in an orientation perpendicular to the rotation axis X, and a tubular wall portion 22 protruding in a direction separating from the intake camshaft 2 and having a tubular shape whose center is the rotation axis X, with the support wall portion 21 and the tubular wall portion 22 being formed integrally with each other.

In a state where an outer surface of the tubular wall portion 22 contacts with an inner surface of the outer case 11, the intermediate member 20 is fitted into the outer case 11 in such a way as to be rotatable relative to the outer case 11, and is fixed to an end portion of the intake camshaft 2 by a connection bolt 23 inserted into a penetration hole at a center of the support wall portion 21. In such a fixed state, an end portion that is in the tubular wall portion 22 and that is on an outer side (on a side farther from the intake camshaft 2) is positioned on an inner side of the front plate 12.

Figure 5:
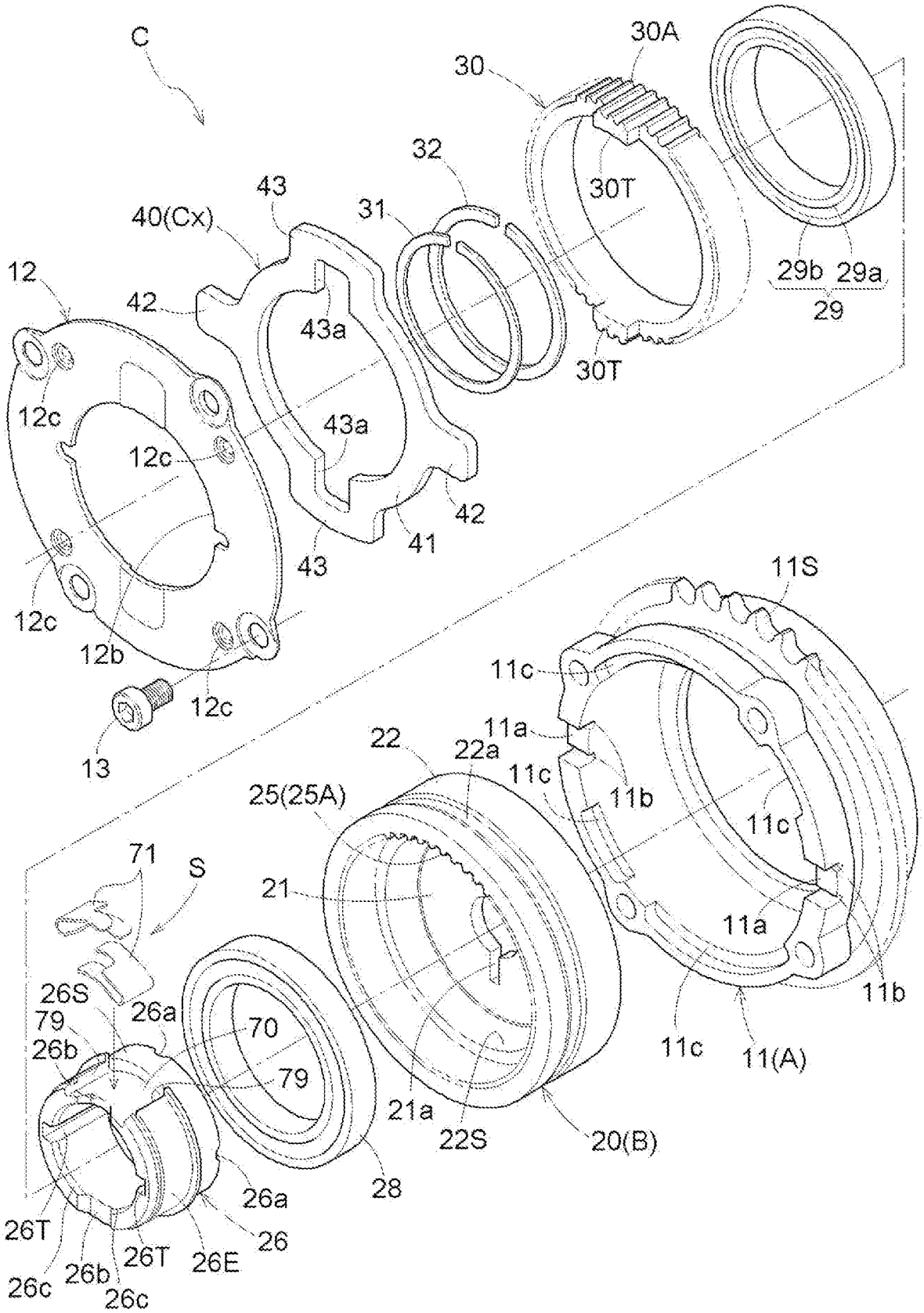
FIG. 5 is a disassembled perspective view of the valve opening-closing timing control apparatus.

As illustrated in FIG. 1 and FIG. 5, a groove portion 22*a* is formed on an outer circumferential side of the tubular wall portion 22 over the entire circumference. The groove portion 22*a* improves a property of oil retention between the outer surface of the tubular wall portion 22 and the inner surface of the outer case 11. Thereby, frictional force between the tubular wall portion 22 and the outer case 11 is reduced, and the intermediate member 20 rotates smoothly relative to the outer case 11.

As illustrated in FIG. 1, the phase control motor M (electric motor) is supported by the engine E via a support frame 7 in such a way that an output shaft Ma of the motor M is arranged coaxially with the rotation axis X. At the output shaft Ma of the phase control motor M, a pair of engagement pins 8 in orientations perpendicular to the rotation axis X are formed.

[Phase Adjustment Mechanism]

As illustrated in FIG. 1 and FIG. 5, the phase adjustment mechanism C is configured in such a way as to include the intermediate member 20, an output gear 25 formed on an inner surface of the tubular wall portion 22 of the intermediate member 20, an eccentric member 26, and an elastic member S, a first bearing 28, a second bearing 29, an input gear 30, a fixing ring 31, a ring-shaped spacer 32, and the oldham joint Cx. As the first bearing 28 and the second bearing 29, ball bearings are used, but bushings may be used.

As illustrated in FIG. 1, at an inner circumference of the tubular wall portion 22 of the intermediate member 20, a support surface 22S whose center is the rotation axis X is formed on an inner side in a direction (hereinafter, referred to as an axial direction) along the rotation axis X (at a position adjacent to the support wall portion 21), and an output gear 25 whose center is the rotation axis X is integrally formed on an outer side of the support surface 22S (on a side farther from the intake camshaft 2).

Figure 2:
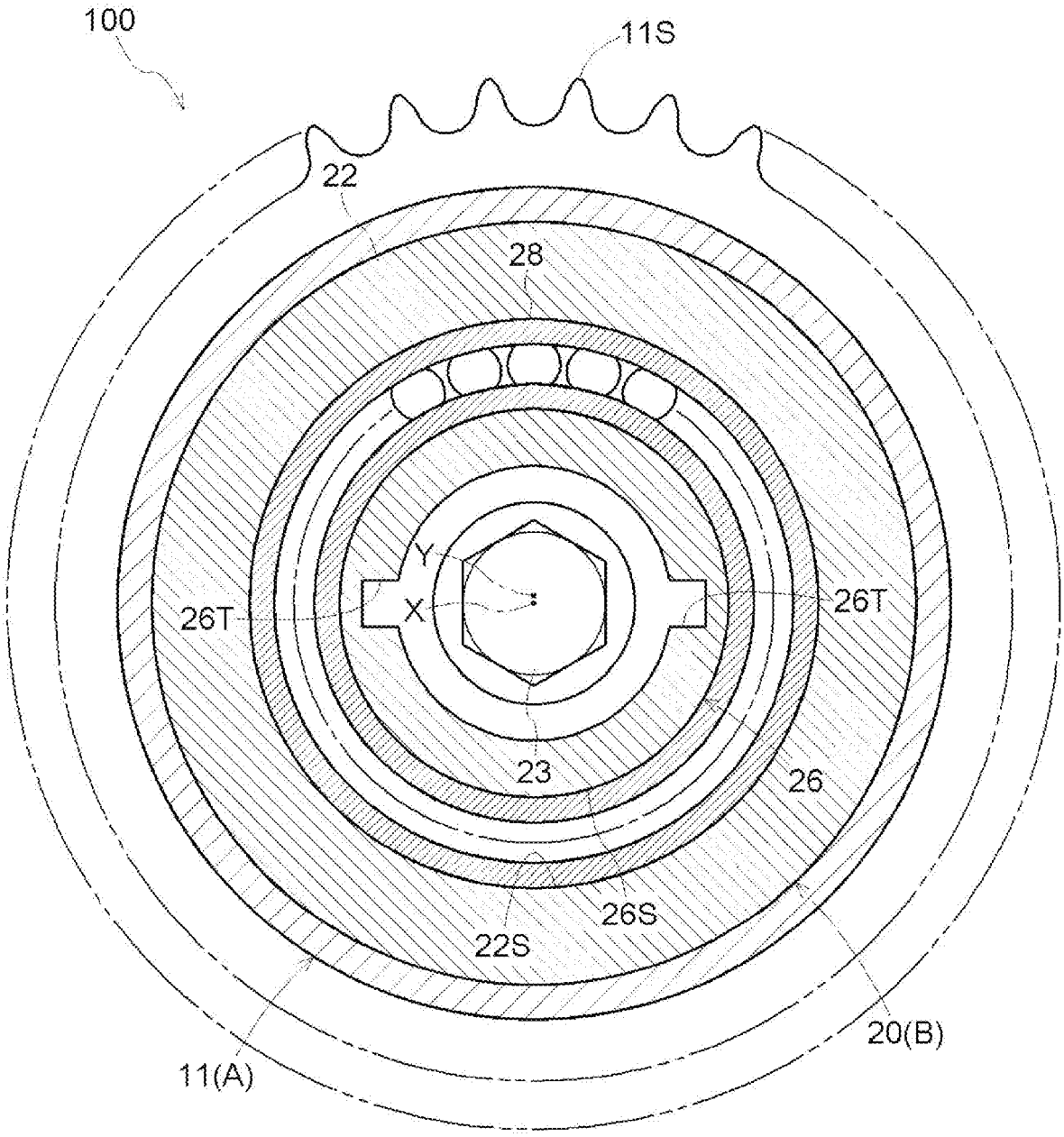
FIG. 2 is a sectional view taken along the line II-II in FIG. 1.
Figure 3:
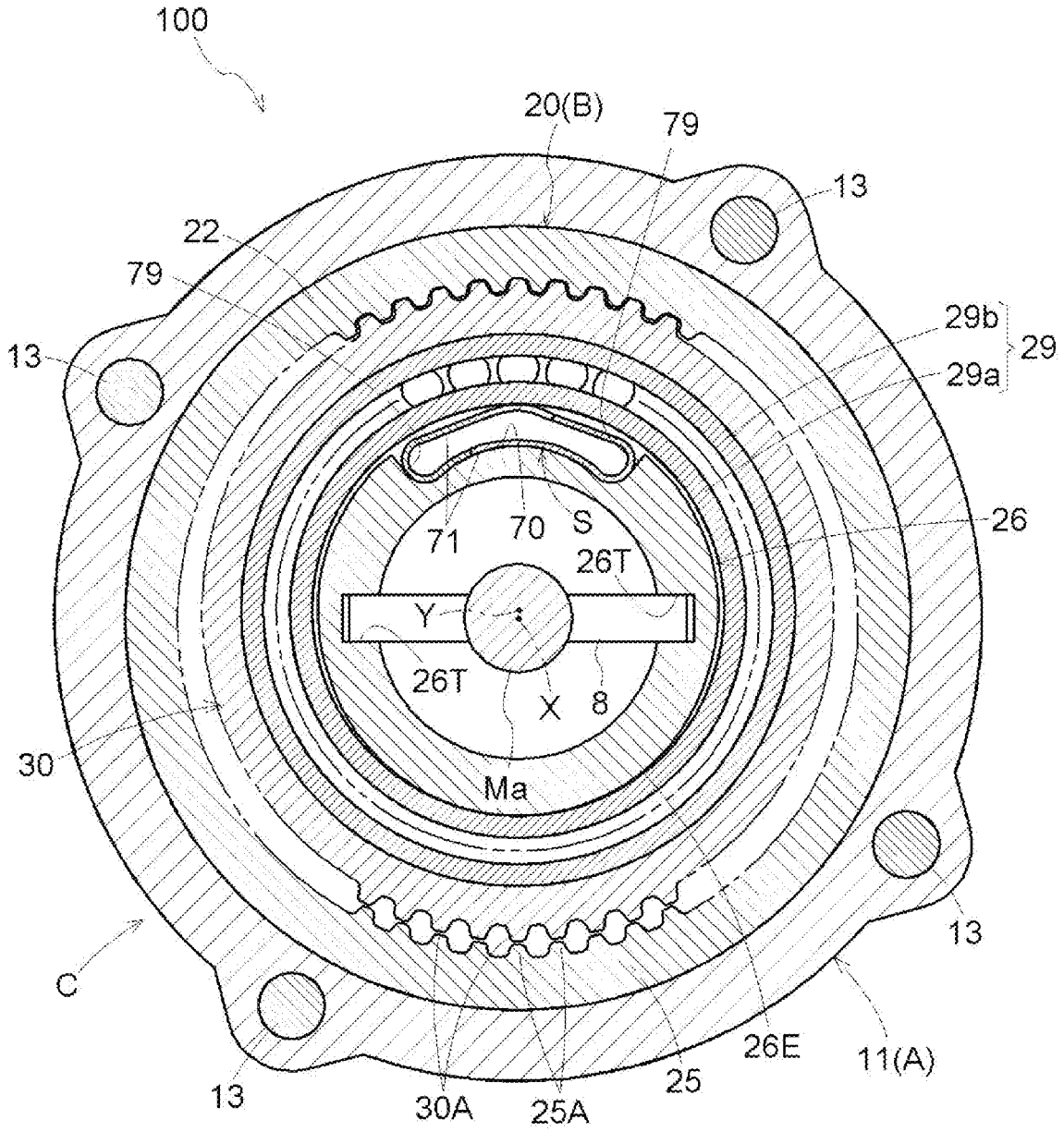
FIG. 3 is a sectional view taken along the line III-Ill in FIG. 1.

As illustrated in FIG. 1, FIG. 2, and FIG. 5, the eccentric member 26 has a tubular shape. At the eccentric member 26, a circumferential support surface 26S as an outer circumferential surface whose center is the rotation axis X is formed on an inner side in the axial direction (on the side closer to the intake camshaft 2). As illustrated in FIG. 1, FIG. 3, and FIG. 5, at the eccentric member 26, an eccentric support surface 26E as an outer circumferential surface whose center is an eccentric axis Y of an orientation parallel to the rotation axis X is formed on an outer side (on the side farther from the intake camshaft 2). Since a direction along the eccentric axis Y is the same as the axial direction, the direction along the eccentric axis Y is also referred to simply as the axial direction, hereinafter.

Figure 6:
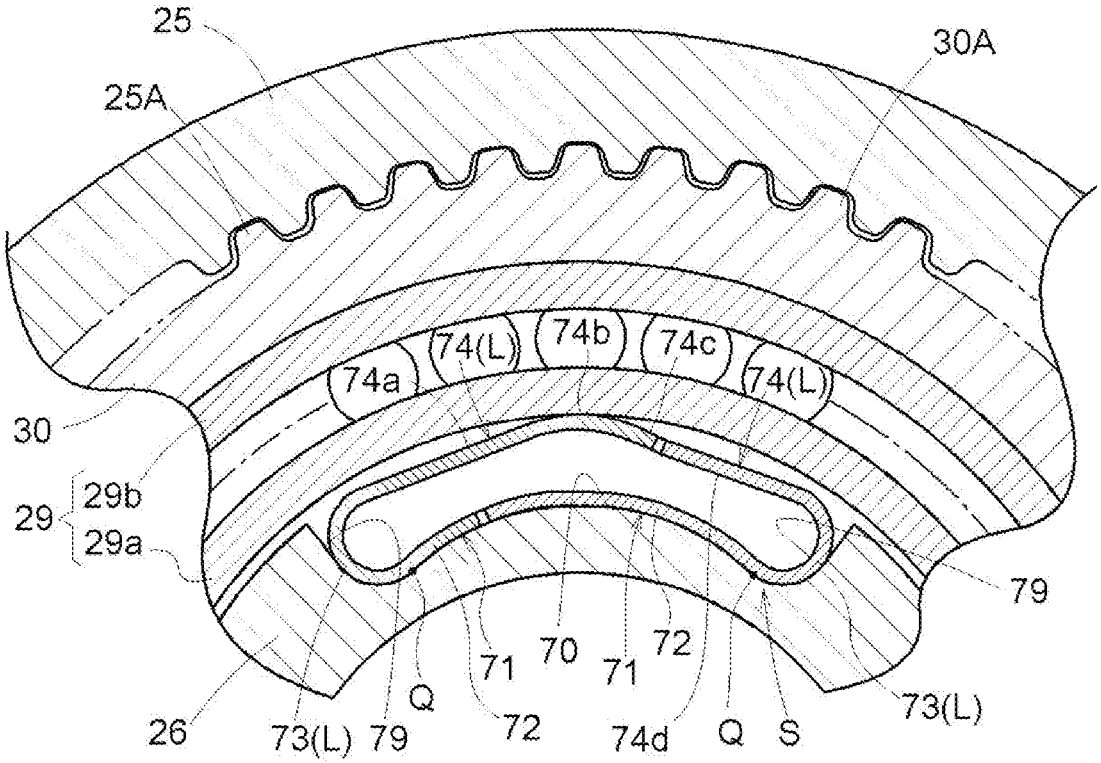
FIG. 6 is a partially enlarged sectional view around a first concave portion, second concave portions, and a pair of spring members.

As illustrated in FIG. 6, on the eccentric support surface 26E, a first concave portion 70 concave inward along a radial direction of the eccentric member 26 is formed. On a bottom surface of the first concave portion 70, a pair of second concave portions 79 and 79 concave in the radial direction toward the axis of the eccentric member 26 are formed at both ends of the bottom surface in a circumferential direction of the eccentric member 26. In the present embodiment, the first concave portion 70 is symmetrical in the circumferential direction of the eccentric member 26 (right-left symmetrical in FIG. 6).

The second concave portions 79 and 79 are formed at the end portions of the first concave portion 70 in the circumferential direction of the eccentric member 26. The maximum depths of bottom surfaces of the second concave portions 79 and 79 in the radial direction of the eccentric member 26 are deeper than a depth of the bottom surface of the first concave portion 70 near a center of the first concave portion 70 in the circumferential direction of the eccentric member 26. A surface of each of the second concave portions 79 and 79 ranging from the bottom surface to an end portion in the circumferential direction of the eccentric member 26 is formed in a shape along a curved shape of a curved portion 73 of the below-described spring member 71.

The elastic member S is fitted into the first concave portion 70 as described below. A relation among the first concave portion 70, the second concave portion 79, and the elastic member S is described below together with description on the elastic member S.

As illustrated in FIG. 1 and FIG. 5, in the inner circumference of the eccentric member 26, a pair of engagement grooves 26T with which a pair of engagement pins 8 of the phase control motor M (refer to FIG. 1) can engage are formed in orientations parallel to the rotation axis X. In the eccentric member 26, on an inner side (on the side of the support wall portion 21), a plurality of first lubrication oil grooves 26*a* (refer to FIG. 1) in orientations along the radial direction are formed, and on an outer side (on the side farther from the intake camshaft 2), a plurality of second lubrication oil grooves 26*b* in orientations along the radial direction are formed. Either the first lubrication oil grooves 26*a* or the second lubrication oil grooves 26*b* may be formed in the eccentric member 26. The numbers of the first lubrication oil grooves 26*a* and the second lubrication oil grooves 26*b* may be set arbitrarily.

As illustrated in FIG. 5, in the eccentric member 26, on an inner circumferential side of an opening end on an outer side (on the side farther from the intake camshaft 2), tapered portions 26*c* (inclined portions) are formed at parts on both sides of the engagement grooves 26T, with diameters of the tapered portions 26 becoming smaller as a position is shifted toward an inner side (the side closer to the intake camshaft 2). When a pair of the engagement pins 8 of the phase control motor M are made to engage with the engagement grooves 26T of the eccentric member 26, the engagement pins 8 are guided to the engagement grooves 26T by the tapered portions 26*c*, and thus, work of making engagement between the phase control motor M and the eccentric member 26 becomes easy.

As illustrated in FIG. 1 and FIG. 2, the first bearing 28 is externally fitted to the circumferential support surface 26S, the first bearing 28 is fitted into the support surface 22S of the tubular wall portion 22, and thereby, the eccentric member 26 is supported in such a way as to be rotatable around the rotation axis X relative to the intermediate member 20. As illustrated in FIG. 1 and FIG. 3, the input gear 30 is supported via the second bearing 29 in such a way as to be rotatable around the eccentric axis Y relative to the eccentric support surface 26E of the eccentric member 26.

In the phase adjustment mechanism C, the number of teeth of an outer tooth portion 30A of the input gear 30 is set to be smaller by one than the number of teeth of an inner tooth portion 25A of the output gear 25. A part of the outer tooth portion 30A of the input gear 30 meshes with a part of the inner tooth portion 25A of the output gear 25.

The elastic member S applies biasing force to the input gear 30 via the second bearing 29 in such a way as to causes a part of the outer tooth portion 30A of the input gear 30 to mesh with a part of the inner tooth portion 25A of the output gear 25. Thereby, backlash between the input gear 30 and the output gear 25 can be prevented from increasing, and abnormal noise can be prevented. Thereby, durability of the input gear 30 and the output gear 25 can be improved.

The elastic member S includes a pair of spring members 71 and 71. In the present embodiment, a pair of the spring members 71 and 71 have the same shape and the same size.

Figure 7:
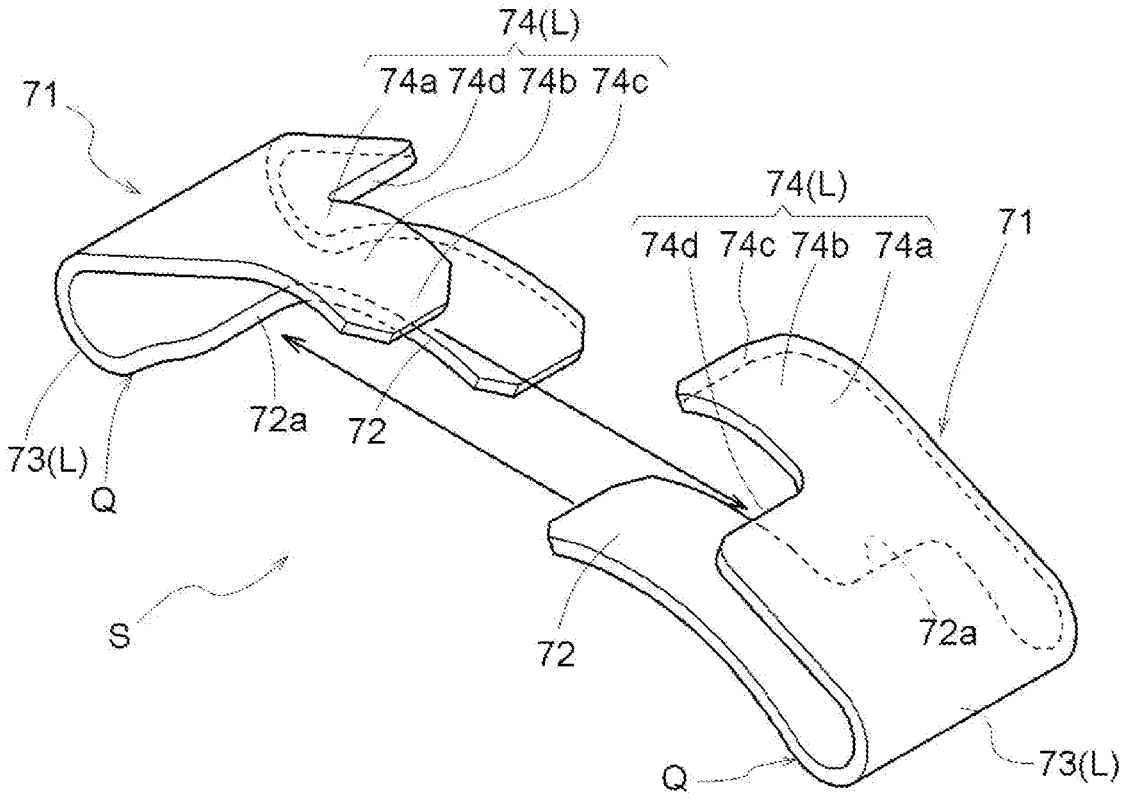
FIG. 7 is a perspective view of a pair of the spring members.

As illustrated in FIG. 7, the spring member 71 is a spring plate material that has been formed into a predetermined shape by bending or the like. The spring member 71 includes a supported portion 72, and an elastically deformable portion L whose one end is supported by the supported portion 72. The elastically deformable portion L includes a curved portion 73 whose one end is supported by the supported portion 72, and a plate part 74*a* in a biasing piece portion 74 whose one end is supported by the other end of the curved portion 73. The supported portion 72, the curved portion 73, and the biasing piece portion 74 are parts of the spring member 71 that is an integrated spring plate material, and the supported portion 72, the curved portion 73, and the biasing piece portion 74 are distinguished from each other for convenience of description of the present embodiment.

As illustrated in FIG. 6, the supported portion 72 is a base portion of the spring member 71, the base portion being fitted into the first concave portion 70 and supported by the eccentric member 26. The supported portion 72 is a plate material curved along the bottom surface of the first concave portion 70. The supported portion 72 is continuous with one end of the below-described curved portion 73, and supports the curved portion 73. When viewed from a side of the curved portion 73, on the opposite end side, the supported portion 72 includes a cutout portion 72*a* cut out in a direction toward the curved portion in the circumferential direction of the eccentric member 26. In the present embodiment, the cutout portion 72*a* is formed on one end side in the axial direction.

As illustrated in FIG. 6 and FIG. 7, the curved portion 73 is a part included in the spring member 71 and having a U-shape into which the spring plate material has been bent. The curved portion 73 is a main part that elastically deforms and thereby generates biasing force of the spring member 71. As described above, one end of the curved portion 73 is supported by the supported portion 72. In FIG. 6 and FIG. 7, a boundary between the supported portion 72 and the curved portion 73 is indicated as a boundary Q. The boundary Q is a fulcrum or a fixed point of the spring member 71 as described below.

The biasing piece portion 74 is a part that is included in the spring member 71 and that biases the input gear 30 via the second bearing 29. As illustrated in FIG. 7, the biasing piece portion 74 is continuous with the other end of the curved portion 73, and includes one end supported by the curved portion 73. The biasing piece portion 74 includes a flat plate-shaped (linear) plate part 74*a* (one example of a linear portion), a top portion 74*b* (one example of a biasing portion) bent from the plate part 74*a* in a direction of approaching the eccentric member 26, a distal end portion 74*c* extending in a flat plate shape from the top portion 74*b*, and a cutout portion 74*d* that is on an end side in the plate portion 74*a* opposite to a side of the curved portion 73 and that is cut out in the circumferential direction of the eccentric member 26 (from a side of the top portion 74*b* toward the side of the curved portion 73). In the present embodiment, the cutout portion 74*d* is formed on an end side opposite to the cutout portion 72*a* in the axial direction.

As illustrated in FIG. 6, a pair of the spring members 71 and 71 are fitted into the one first concave portion 70 in such a way as to be combined in opposite orientations (in symmetry with respect to a line along the radial direction of the eccentric member 26) and to function as the one-unit elastic member S. At this time, a pair of the spring members 71 and 71 fitted into the first concave portion 70 in a positional relation in which the curved portions 73 and 73 are separated from each other, the biasing piece portions 74 and 74 are close to each other, and the supported portions 72 and 72 are close to each other. As for a pair of the spring members 71 and 71, the supported portions 72 and 72 are fitted into the first concave portion 70 in a state where the top portions 74*b* and 74*b* of the biasing piece portions 74 and 74 face the second bearing 29 (input gear 30). In this manner, the elastic member S is held by the one first concave portion 70, and thus, balance of biasing force applied to the input gear 30 by the elastic member S is unlikely to be disturbed.

In a state where a pair of the spring members 71 and 71 are fitted into the first concave portion 70, a distal end of the distal end portion 74*c* of the biasing piece portion 74 in the one spring member 71 and an edge of the cutout portion 74*d* of the biasing piece portion 74 in the other spring member 71 are close to each other but separated from each other by a predetermined distance in the circumferential direction of the eccentric member 26. A distal end of the supported portion 72 in the one spring member 71 and an edge of the cutout portion 72*a* of the supported portion 72 in the other spring member 71 are close to each other but separated from each other by a predetermined distance. Such separation therebetween by the predetermined distances avoids collision between the distal end of the distal end portion 74*c* of the biasing piece portion 74 in the one spring member 71 and the edge of the cutout portion 74*d* of the biasing piece portion 74 in the other spring member 71 and collision between the distal end of the supported portion 72 in the one spring member 71 and the edge of the cutout portion 72*a* of the supported portion 72 in the other spring member 71 even when elastic deformation occurs in such a way that both sides of the U-shapes of each of the curved portions 73 and 73 become close to each other (a curvature radius becomes small) as described below. Avoiding such collision can prevent generation of metal powder or the like and thereby improve durability, and can prevent a malfunction.

In a state where a pair of the spring members 71 and 71 are fitted into the first concave portion 70, parts of the curved portions 73 are fitted into (accommodated in) the second concave portions 79. Providing the second concave portion 79 that accommodates the curved portion 73 can increase a curvature radius of the curved portion 73 and thereby prevent local deformation of the curved portion 73, and can improve durability.

In a state where a pair of the spring members 71 and 71 are fitted into the first concave portion 70, the top portions 74*b* and 74*b* overlap with each other in the axial direction. In other words, the top portions 74*b* and 74*b* are positioned at the same position in the radial direction of the eccentric member 26, and are arranged at the front and the rear in the axial direction. In this state, a pair of the spring members 71 and 71 disperse biasing force to two different positions, i.e., the top portions 74*b* and 74*b*, and biases the second bearing 29 (input gear 30), and thus, variations in elastic force and biasing force of the elastic member S are easily adjusted. Further, the elastic member S can be made compact.

In a state where a pair of the spring members 71 and 71 (elastic member S) are fitted into the first concave portions 70, and the top portions 74*b* and 74*b* contact against the second bearing 29 (input gear 30) and bias the second bearing 29, the curved portions 73 and 73 entirely deform due to the reaction force in such a way as to make both sides of the U-shape of the curved portion 73 close to each other (make a bending radius small), and are separated from the input gear 30. At this time, the reaction force also acts on the plate parts 74*a* and 74*a*, and thus, there is a case where sides of the distal end portions 74*c* (top portions 74*b*) in the plate parts 74*a* and 74*a* flexibly deform in such a way as to be separated from the input gear 30. The curved portions 73 and 73 and the plate parts 74*a* and 74*a* are always separated from the second bearing 29.

In a state where the top portion 74*b* contacts against the second bearing 29 (input gear 30) and biases the second bearing 29, the plate part 74*a* and the supported portion 72 in the same spring member 71 at least partially overlap with each other when viewed in the radial direction. Thereby, reaction force from the top portion 74*b* can be supported by the supported portion 72. In addition to this, the plate part 74*a* in the one spring member 71 at least partially overlap with the supported portion 72 in the other spring member 71 when viewed in the radial direction, as well. Thereby, the second bearing 29 (input gear 30) can be supported by a pair of the spring members 71 and 71 in a well-balanced manner.

In a state where the top portions 74*b* and 74*b* contact against the second bearing 29 (input gear 30) and bias the second bearing 29, the fulcrums (fixed points) of the spring members 71 and 71 are areas on front and back sides of and in the vicinities of the boundaries Q and Q (one example of two different locations) in the circumferential direction of the eccentric member 26. In this manner, the elastic member S is supported by the first concave portion 70 at the two different locations in the circumferential direction of the eccentric member 26, and thus, a variation in biasing force can be made small. In other words, the elastic member S can disperse reaction force against the biasing force to these two locations (the vicinities of the boundaries Q and Q). Thus, it is possible easily make adjustment of elastic force of the elastic member S, i.e., balance adjustment of biasing force applied to the input gear 30. When the spring member 71 applies biasing force to the second bearing 29 (input gear 30) by the top portion 74*b*, the fulcrum (fixed point) in the present embodiment represents a part that maintains a state where the spring member 71 contacts against the eccentric member 26 in a state of biasing the eccentric member 26 by the reaction force.

As illustrated in FIG. 1 and FIG. 5, the fixing ring 31 is supported in a state of being fitted into an outer circumference of the eccentric member 26, and thereby prevents the second bearing 29 from slipping off.

[Phase Adjustment Mechanism: Oldham Joint]

Figure 4:
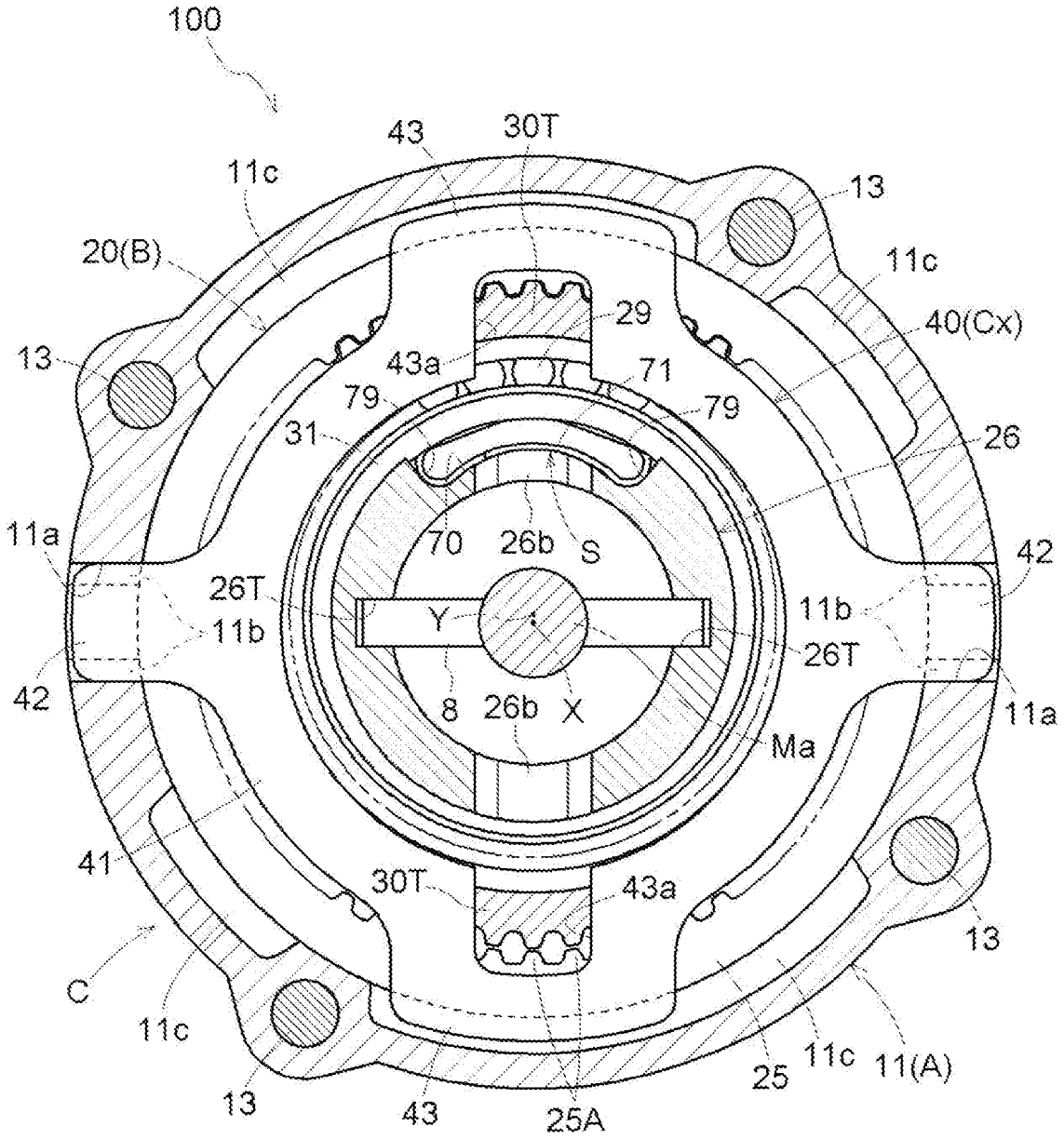
FIG. 4 is a sectional view taken along the line IV-IV in FIG. 1.

As illustrated in FIG. 1, FIG. 4, and FIG. 5, the oldham joint Cx constituted by a plate-shaped joint member 40 in which a central annular portion 41, a pair of outer engagement arms 42 protruding radially outward from the annular portion 41 along a first direction (the left-right direction in FIG. 4), and inner engagement arms 43 protruding radially outward from the annular portion 41 along a direction (the up-down direction in FIG. 4) perpendicular to the first direction are formed integrally with each other. In each of a pair of the inner engagement arms 43, an engagement concave portion 43*a* continuous with an opening of the annular portion 41 is formed.

A pair of guide groove portions 11*a* extending from an inner space of the outer case 11 to an outer space in the radial direction with respect to the rotation axis X as a center is each formed in a penetration groove shape at an opening edge portion that is included in the outer case 11 and against which the front plate 12 contacts. A groove width of the guide groove portion 11*a* is set to be slightly wider than a width of the outer engagement arm 42, and in each of the guide groove portions 11*a*, a pair of discharge flow paths 11*b* are formed by cutting-out. The discharge path 11*b* may be formed in the front plate 12 in such a way that lubrication oil flows in the radial direction.

In the opening edge portion of the outer case 11, one or more pocket portions 11*c* cut out on an inner circumferential side along the circumferential direction are formed at places other than the guide groove portions 11*a*. In the pocket portion 11*c*, foreign matters moving to an outer circumferential side due to centrifugal force generated by rotation of the driving-side rotor A are collected. FIG. 5 illustrates a case where the four pocket portions 11*c* are formed.

On an end surface included in the input gear 30 and facing the front plate 12, a pair of engagement protrusions 30T are integrally formed. An engagement width of the engagement protrusion 30T is set to be slightly smaller than an engagement width of the engagement concave portion 43*a* of the inner engagement arm 43.

In such a configuration, a pair of the outer engagement arms 42 of the joint member 40 are made to engage with a pair of the guide groove portions 11*a* of the outer case 11, and a pair of the engagement protrusions 30T of the input gear 30 are made to engage with the engagement concave portions 43*a* of a pair of the inner engagement arms 43 of the joint member 40, thereby enabling the oldham joint Cx to function.

The joint member 40 can be displaced relative to the outer case 11 in the first direction (the left-right direction in FIG. 4) in which the outer engagement arms 42 extend, and the input gear 30 is freely displaced relative to the joint member 40 in the second direction (the up-down direction in FIG. 4) along the forming direction of the engagement concave portions 43*a* of the inner engagement arms 43.

As illustrated in FIG. 1 and FIG. 5, by the spacer 32, a distance of a gap by which the second bearing 29 can move in the axial direction is set to be equal to or smaller than a predetermined set value. By providing the spacer 32 between the oldham joint Cx (joint member 40) and the second bearing 29, movement of the second bearing 29 in the axial direction is restricted within a distance equal to or smaller than the predetermined set value. Thereby, the engagement protrusions 30T of the input gear 30 can be prevented from contacting with the front plate 12.

[Arrangement of Each Portion of Valve Opening-Closing Timing Control Apparatus]

In the valve opening-closing timing control apparatus 100 in an assembled state, as illustrated in FIG. 1, the support wall portion 21 of the intermediate member 20 is connected to the end portion of the intake camshaft 2 by the connection bolt 23, and these rotate integrally. The eccentric member 26 is supported by the first bearing 28 in such a way as to be rotatable around the rotation axis X relative to the intermediate member 20. As illustrated in FIG. 1 and FIG. 3, the input gear 30 is supported by the eccentric support surface 26E of the eccentric member 26 via the second bearing 29, and a part of the outer tooth portion 30A of the input gear 30 meshes with a part of the inner tooth portion 25A of the output gear 25.

As illustrated in FIG. 4, the outer engagement arms 42 of the oldham joint Cx engage with a pair of the guide groove portions 11*a* of the outer case 11, and the engagement protrusions 30T of the input gear 30 engage with the engagement concave portions 43*a* of the inner engagement arms 43 of the oldham joint Cx. Since the front plate 12 is arranged on an outer side of the joint member 40 of the oldham joint Cx as illustrated in FIG. 1, the joint member 40 can move in a direction perpendicular to the rotation axis X in a state of contacting with the inner surface of the front plate 12. By this arrangement, the oldham joint Cx is arranged on an outer side of the first bearing 28 and the second bearing 29 (the side farther from the intake camshaft 2) and on an inner side of the front plate 12 (the side closer to the intake camshaft 2).

As illustrated in FIG. 1 to FIG. 3, a pair of the engagement pins 8 formed at the output shaft Ma of the phase control motor M engage with the engagement grooves 26T of the eccentric member 26.

[Operation Mode of Phase Adjustment Mechanism]

Although not illustrated in the drawing, a control device configured as an ECU controls the phase control motor M. The engine E is provided with sensors capable of detecting rotational speeds (the numbers of rotations per unit time) and rotational phases of the crankshaft 1 and the intake camshaft 2, and detection signals from these sensors are input to the control device.

At the time of operation of the engine E, the control device drives the phase control motor M at a speed equal to a rotational speed of the intake camshaft 2, thereby maintaining a relative rotation phase. Meanwhile, advance operation is performed by making a rotational speed of the phase control motor M lower than a rotational speed of the intake camshaft 2. Conversely, retard operation is performed by making a rotational speed higher. As described above, the advance operation increases an intake compression ratio, and the retard operation decreases an intake compression ratio.

When the phase control motor M rotates at the same speed as that of the outer case 11 (at the same speed as that of the intake camshaft 2), a position where the outer tooth portion 30A of the input gear 30 meshes with the inner tooth portion 25A of the output gear 25 does not change, and thus, a relative rotation phase of the driven-side rotor B to the driving-side rotor A is maintained.

Meanwhile, driving and rotating the output shaft Ma of the phase control motor M at a speed higher or lower than a rotation speed of the outer case 11 causes the eccentric axis Y in the phase adjusting mechanism C to revolve around the rotation axis X. By this revolution, a position where the outer tooth portion 30A of the input gear 30 meshes with the inner tooth portion 25A of the output gear 25 is displaced along the inner circumference of the output gear 25, and rotational force acts between the input gear 30 and the output gear 25. In other words, the force of rotation whose center is the rotation axis X acts on the output gear 25, and the rotational force causing rotation whose center is the eccentric axis Y as an axis of the input gear 30 acts on the input gear 30.

As described above, the engagement protrusions 30T engage with the engagement concave portions 43*a* of the inner engagement arms 43 of the joint member 40, and for this reason, the input gear 30 does not rotate around its own axis relative to the outer case 11, and rotational force thereof acts on the output gear 25. This action of the rotational force causes the intermediate member 20 to rotate together with the output gear 25 around the rotation axis X relative to the outer case 11. As a result, a relative rotation phase between the driving-side rotor A and the driven-side rotor B is set, and a setting of timings of opening and closing made by the intake camshaft 2 is implemented.

When the eccentric axis Y of the input gear 30 revolves around the rotation axis X, accompanying with displacement of the input gear 30, the joint member 40 of the oldham joint Cx is displaced relative to the outer case 11 in the direction (first direction) in which the outer engagement arms 42 extend, and input gear 30 is displaced in the direction (second direction) in which the inner engagement arms 43 extend.

As described above, the number of teeth of the outer tooth portion 30A of the input gear 30 is set to be smaller by one than the number of teeth of the inner tooth portion 25A of the output gear 25, and thus, when the eccentric axis Y of the input gear 30 makes one revolution around the rotation axis X, the output gear 25 makes rotation by one tooth, achieving large deceleration.

[Lubrication of Phase Adjustment Mechanism]

As illustrated in FIG. 1, a lubrication oil path 15 to which lubrication oil from an external oil pump P is supplied via an oil path forming member 9 is formed in the intake camshaft 2. An opening portion 21*a* for guiding oil to an inside of the eccentric member 26 is formed in a part of a surface included in the support wall portion 21 of the intermediate member 20 and contacting against the intake camshaft 2.

As described above, a plurality of the first lubrication oil grooves 26*a* and a plurality of the second lubrication oil grooves 26*b* are formed in the eccentric member 26 (refer to FIG. 1 and FIG. 5). On the surface included in the front plate 12 and facing the joint member 40, a lubrication concave portion 12*a* as a slight gap is formed between the surface of the front plate 12 and the surface of the joint member 40 along the radial direction. This lubrication concave portion 12*a* is formed on an inner circumferential side of the front plate 12, but may be formed in an area reaching an outer circumference of the front plate 12, or lubrication oil may be supplied to a gap between the front plate 12 and the joint member 40 with the lubrication concave portion 12*a* being omitted.

As described above, a pair of the discharge flow paths 11*b* are formed in the guide groove portion 11*a* (refer to FIG. 4 and FIG. 5). An opening diameter of an opening 12*b* of the front plate 12 is made sufficiently larger than an inner diameter of the eccentric member 26, and thereby, a step G is formed between an opening edge of the front plate 12 and an inner circumference of the eccentric member 26.

With this configuration, lubrication oil supplied from the oil pump P is supplied from the lubrication oil path 15 of the intake camshaft 2 to an inner space of the eccentric member 26 via the opening portion 21*a* of the support wall portion 21 of the intermediate member 20. The thus-supplied lubrication oil is supplied from the first lubrication oil grooves 26*a* of the eccentric member 26 to the first bearing 28 by centrifugal force, enabling smooth operation of the first bearing 28.

At the same time, the lubrication oil in the inner space of the eccentric member 26 is supplied from the second lubrication oil grooves 26*b* to the joint member 40 by the centrifugal force, is also supplied to the second bearing 29, and is supplied between the inner gear portion 25A of the output gear 25 and the outer gear portion 30A of the input gear 30.

As illustrated in FIG. 1, the lubrication oil from the second lubrication oil grooves 26*b* is supplied between the front plate 12 and the joint member 40 by the lubrication concave portion 12*a*, and is also supplied to gaps between the outer engagement arms 42 of the joint member 40 and the guide grooves 11*a* of the outer case 11. Thereby, the joint member 40 is enabled to smoothly operate. The lubrication oil supplied to the joint member 40 is discharged from the gaps between the outer engagement arms 42 of the joint member 40 and the guide grooves 11*a* of the outer case 11 to an outside.

Particularly, the step G is formed between the opening edge of the front plate 12 and the inner circumference of the eccentric member 26, and for this reason, when the engine E is stopped, the lubrication oil in the inner space of the eccentric member 26 is discharged from the opening 12*b* of the front plate 12, and an amount of the lubrication oil remaining inside can be reduced. When a large amount of lubrication oil remains inside the valve opening-closing timing control apparatus 100, after the engine E is started to operate in a cold environment, operation of the phase adjustment mechanism C is suppressed due to viscosity of the lubrication oil. However, such a disadvantage can be solved by discharging the lubrication oil when the engine E is stopped.

Since the discharge paths 11*b* are formed in the guide groove portions 11*a*, when the engine E in a stopped state is started to operate in a cold environment, centrifugal force causes inside lubrication oil to be promptly discharged through the discharge paths 11*b*, and thus, the highly viscous lubrication oil is discharged in short time, and the phase adjustment mechanism C can be promptly operated with influence of viscosity of the lubrication oil being removed.

Figure 8:
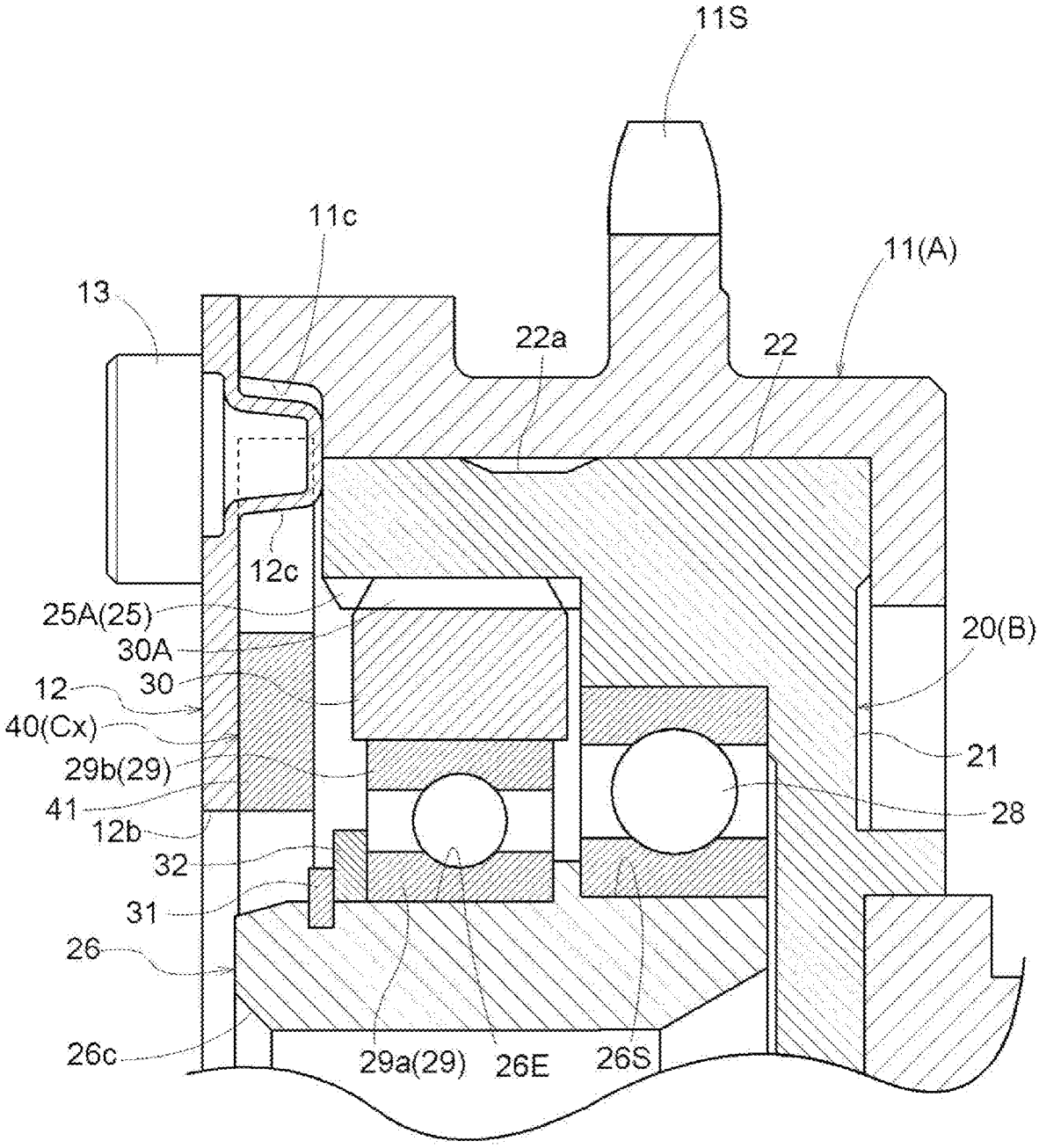
FIG. 8 is a partially enlarged sectional view around a convex portion of a front plate.

As illustrated in FIG. 5 and FIG. 8, in the front plate 12, convex portions 12*c* protruding inward are formed on the surface on an inner side (on the side closer to the intake camshaft 2). The convex portion 12*c* lightly contacts with the intermediate member 20 to such a degree so as to be slidable on the intermediate member 20. The intermediate member 20 is restricted from moving toward the front plate 12 by contacting against the convex portions 12*c*. Thereby, the oldham joint Cx (joint member 40) can be operated smoothly (with less friction) in a state where a predetermined interval is maintained between the front plate 12 and the intermediate member 20.

Operation and Effect of Embodiment

With this configuration, the first bearing 28 and the second bearing 29 can be arranged in positions comparatively close to each other inside the intermediate member 20, the joint member 40 of the oldham joint Cx is configured with a plate material, and thus, size reduction of the valve opening-closing timing control apparatus 100 in the axial direction is achieved.

The eccentric member 26 is supported by the inner-circumference support surface 22S of the intermediate member 20 via the first bearing 28, and the input gear 30 is supported by the eccentric support surface 26E of the eccentric member 26 via the second bearing 29. Accordingly, even when biasing force of the elastic member S acts in a direction of changing an orientation of the eccentric member 26, the entire outer circumference of the circumferential support surface 26S of the eccentric member 26 is held by the first bearing 28 in such a way as to be enclosed by the inner circumference of the intermediate member 20, and a positional relation between the eccentric member 26 and the intermediate member 20 can be maintained.

Particularly, in this configuration, biasing force of the elastic member S acts only between the eccentric member 26 and the intermediate member 20, and does not act on external members, and thus, for example, deformation and displacement of the external members due to the biasing force of the elastic member S does not need to be considered, and an orientation of the eccentric member 26 can be maintained with higher accuracy.

Forming the first lubrication oil grooves 26*a* and the second lubrication oil grooves 26*b* for allowing lubrication oil to flow to end portions of the eccentric member 26 enables smooth operation of the oldham joint Cx, enables smooth operation of the first bearing 28 and the second bearing 29, and enables smooth meshing between the inner gear portion 25A of the output gear 25 and the outer gear portion 30A of the input gear 30, reducing a load that acts on the phase control motor M. Forming the first lubrication oil grooves 26*a* and the second lubrication oil grooves 26*b* in this manner causes lubrication oil to be supplied to the necessary locations, and thus, lubrication oil is prevented from becoming useless, and a lubrication oil amount can be reduced.

Particularly, supplying lubrication oil between the front plate 12 and the joint member 40 constituting the oldham joint Cx enables smooth operation of the joint member 40, and can more reduce a load acting on the phase control motor M.

In the phase adjustment mechanism C, strong force acts on a meshing portion between the inner tooth portion 25A of the output gear 25 and the outer tooth portion 30A of the input gear 30, and for this reason, there is a case where dust is generated at this place. However, the bearings are not arranged downstream of the meshing portion in a direction in which lubrication oil flows, and thus, influence of dust and the like is removed, and damage to the bearings can be also suppressed.

Particularly, in this configuration, lubrication oil can be discharged by centrifugal force, and thus, dust, foreign matters, and the like can be discharged, and in addition, when the engine E is stopped, the lubrication oil is proactively discharged, and dust, foreign matters, and the like are thereby prevented from remaining inside.

Other Embodiments (1) In the above-described embodiment, the exemplified case is one where the phase adjustment mechanism C is configured in such a manner as to include the intermediate member 20, the output gear 25 formed on the inner circumferential surface of the tubular wall portion 22 of the intermediate member 20, the eccentric member 26, the elastic member S, the first bearing 28, the second bearing 29, the input gear 30, the fixing ring 31, the ring-shaped spacer 32, and the oldham coupling Cx, and the description is made on the matter that the spacer 32 restricts movement of the second bearing 29 in the axial direction within a distance equal to or smaller than a predetermined set value, and contact between the engagement protrusions 30T of the input gear 30 and the front plate 12 can be prevented. However, prevention of contact between the engagement protrusions 30T of the input gear 30 and the front plate 12 is not limited to the above-described mode.

Figure 9:
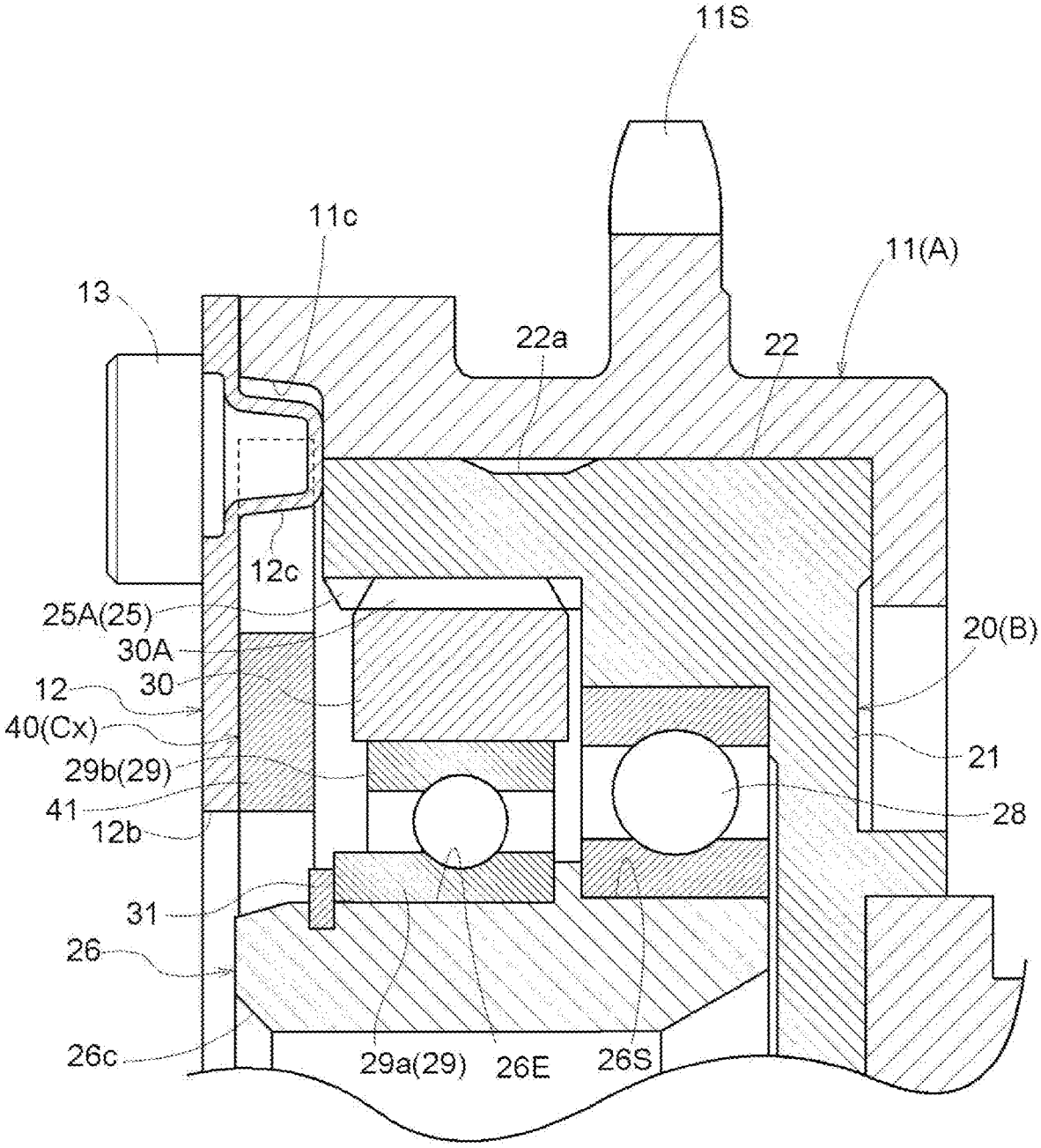
FIG. 9 is a partially enlarged sectional view in the vicinity of the front plate and a second bearing.

For example, as illustrated in FIG. 9, in addition to the ring-shaped spacer 32 or instead of the ring-shaped spacer 32, a side surface included in an inner ring 29*a* of the second bearing 29 and on a side of the front plate 12 in the axial direction may be made to protrude relative to a side surface of an outer ring 29*b*. Even in this case, movement of the second bearing 29 in the axial direction can be restricted within a distance equal to or smaller than a predetermined set value, and contact between the engagement protrusions 30T of the input gear 30 and the front plate 12 can be prevented. FIG. 9 illustrates the case where the side surface included in the inner ring 29*a* of the second bearing 29 and on the side of the front plate 12 in the axial direction may be made to protrude relative to the side surface of the outer ring 29*b*, instead of providing the ring-shaped spacer 32.

(2) In the above-described embodiment, the description is made on the exemplified case where the elastic member S includes a pair of the spring members 71 and 71, and a pair of the spring members 71 each include the supported portion 72, the curved portion 73 whose one end is supported by the supported portion 72, and the biasing piece portion 74 whose one end is supported by the other end of the curved portion 73. However, the elastic member S is not limited to the case of being provided with a pair of the spring members 71 and 71.

The elastic member S may include at least a pair of the curved portions 73 and 73. For example, there is a case where the elastic member S includes an integrated supported portion instead of the supported portions 72 and 72, and boundaries between the supported portion and the curved portions 73 and 73 are boundaries Q and Q functioning as fulcrums or fixed points. Instead of the biasing piece portions 74 and 74, an integrated biasing portion may be provided, and instead of biasing the second bearing 29 (input gear 30) by the top portions 74*b* and 74*b*, the second bearing 29 may be biased by one top portion of the integrated biasing portion.

(3) In the above-described embodiment, the description is made on the exemplified case where the curved portion 73 is a part included in the spring member 71 and having a U-shape into which a spring plate material has been bent. However, the curved portion 73 is not limited to the case of the spring plate material bent into a U-shape. For example, instead of the spring plate material bent into a U-shape, a torsion coil spring may be used as the curved portion 73.

Also in this case, the surface from the bottom surface to the end portion in each of the second concave portions 79 and 79 may be formed in a shape along a coil part of the curved portion 73.

(4) In the above-described embodiment, the description is made on the case where in a state where a pair of the spring members 71 and 71 are fitted into the first concave portion 70, the distal end of the distal end portion 74*c* of the biasing piece portion 74 in the one spring member 71 and the edge of the cutout portion 74*d* of the biasing piece portion 74 in the other spring member 71 are close to each other but separated from each other by a predetermined distance in the circumferential direction of the eccentric member 26. However, the distal end of the tip end portion 74*c* of the biasing piece portion 74 in the one spring member 71 and the edge of the cutout portion 74*d* of the biasing piece portion 74 in the other spring member 71 are not necessarily limited to the mode of being close to each other but separated from each other by a predetermined distance.

As another mode, there is a case where when a pair of the spring members 71 and 71 are fitted into the first concave portion 70, a distal end portion of the distal end portion 74*c* of the biasing piece portion 74 in the one spring member 71 and an edge portion of the cutout portion 74*d* of the biasing piece portion 74 in the other spring member 71 are made to overlap with each other when viewed in the radial direction of the eccentric member 26. For example, in the radial direction of the eccentric member 26, the distal end portion of the distal end portion 74*c* may be arranged in such a way as to be on an outer side (on the side closer to the second bearing 29) of the edge portion of the cutout portion 74*d*. In this manner, the edge of the cutout portion 74*d* on the one side is restricted in the radial direction by the distal end portion of the distal end portion 74*c* in the biasing piece portion 74 on the other side, and biasing force can be stably maintained in a state where the spring members 71 are fitted into the first concave portion 70, and even when the both sides of the U-shapes of the curved portions 73 and 73 elastically deform in such a way as to become close to each other, it is possible to avoid contact between the distal end of the distal end portion 74*c* of the biasing piece portion 74 in the one spring member 71 and the edge of the cutout portion 74*d* of the biasing piece portion 74 in the other spring member 71.

(5) In the above-described embodiment, the description is made on the case where with a pair of the spring members 71 and 71 being fitted into the first concave portion 70, the distal end of the supported portion 72 in the one spring member 71 and the edge of the cutout portion 72*a* of the supported portion 72 in the other spring member 71 are adjacent to each other but separated from each other by a predetermined distance. However, the distal end of the supported portion 72 in the one spring member 71 and the edge of the cutout portion 72*a* of the supported portion 72 in the other spring member 71 are not necessarily limited to the mode of being adjacent to each other but separated from each other by a predetermined distance.

As another mode, there is a case where when a pair of the spring members 71 and 71 are fitted into the first concave portion 70, a distal end portion of the supported portion 72 in the one spring member 71 and an edge portion of the cutout portion 72*a* of the supported portion 72 in the other spring member 71 are made to overlap with each other when viewed in the radial direction of the eccentric member 26. For example, in the radial direction of the eccentric member 26, the edge portion of the cutout portion 72*a* may be arranged in such a way as to be on an outer side (on the side closer to the second bearing 29) of the distal end portion of the supported portion 72. In this manner, the distal end of the supported portion 72 on the one side is restricted in the radial direction by the edge portion of the cutout portion 72*a* on the other side, and a state where the spring members 71 are fitted into the first concave portion 70 can be stably maintained, and even when the both sides of the U-shapes of the curved portions 73 and 73 elastically deform in such a way as to become close to each other, it is possible to avoid contact between the distal end of the supported portion 72 in the one spring member 71 and the edge of the cutout portion 72*a* of the supported portion 72 in the other spring member 71.

This disclosure can be used in a valve opening-closing timing control apparatus.

A valve opening-closing timing control apparatus according to this disclosure includes a driving-side rotor, a driven-side rotor, and a phase adjustment mechanism. The driving-side rotor rotates around a rotation axis in synchronization with a crankshaft of an internal combustion engine. The driven-side rotor is arranged coaxially with the rotation axis and on an inner side of the driving-side rotor, and rotates integrally with a camshaft for opening and closing a valve of the internal combustion engine. The phase adjustment mechanism sets a relative rotation phase between the driving-side rotor and the driven-side rotor.

The phase adjustment mechanism includes an output gear, an input gear, a tubular eccentric member, a first bearing, a second bearing, and an elastic member. The output gear is provided at the driven-side rotor in such a way as to be coaxial with the rotation axis. The input gear rotates around an eccentric axis in an orientation parallel to the rotation axis, and is connected to the driving-side rotor. The tubular eccentric member supports the input gear from an inner circumferential side, and allows the input gear to rotate. The first bearing is arranged between an inner circumference of the driven-side rotor and an outer circumference of the eccentric member. The second bearing is arranged between an inner circumference of the input gear and an outer circumference of the eccentric member and on a side farther from the camshaft than the first bearing in a direction along the rotation axis. The elastic member is arranged between an outer circumferential side of the eccentric member and an inner circumferential side of the second bearing and along a circumferential direction of the eccentric member, and applies biasing force to the input gear in such a way as to cause a part of the input gear to mesh with a part of the output gear.

Rotation of the eccentric member causes the eccentric axis to revolve and thereby changes a position where the output gear meshes with the input gear. The eccentric member includes one first concave portion formed on an outer circumferential surface along the circumferential direction. The elastic member includes a supported portion, an elastically deformable portion, and a biasing portion. The supported portion is supported by a bottom surface of the first concave portion. The elastically deformable portion is supported by the supported portion, and generates the biasing force. The biasing portion is supported by the elastically deformable portion, and applies the biasing force to the input gear. The elastic member is accommodated in the first concave portion, and is supported, by the first concave portion, at two different locations in the circumferential direction.

According to the above-described configuration, the elastic member is accommodated in one first concave portion, the supported portion is held by the bottom surface of the first concave portion, and thus, the elastic member is stably held. For this reason, balance of biasing force applied to the input gear by the elastic member is unlikely to be disturbed. As a result, backlash between the input gear and the output gear can be prevented from increasing, and the valve opening-closing timing control apparatus can be made silent.

According to the above-described configuration, the elastic member is supported at two different locations in the circumferential direction of the eccentric member, and accordingly, the elastic member can disperse reaction force against biasing force to these two locations and receive the reaction force. Thus, adjustment of elastic force of the elastic member, i.e., balance adjustment of biasing force applied to the input gear can be made easily. Therefore, the valve opening-closing timing control apparatus can be made silent. The balance adjustment of biasing force includes meaning of adjustment of biasing force as an initial value at a time of assembling the valve opening-closing timing control apparatus, adjustment (suppression) of a variation in biasing force at a time of use (operation), and adjustment (suppression) of degradation and fluctuation accompanying use.

In the valve opening-closing timing control apparatus according to this disclosure, the elastic member may apply the biasing force to the input gear at two locations being different from each other in an axial direction of the eccentric axis and overlapping with each other when viewed in the axial direction.

According to the above-described configuration, the elastic member biases the input gear at two different positions (axial-direction front and rear) in the axial direction of the eccentric member, and accordingly, the elastic member can disperse the biasing force to these two locations. Thus, adjustment of elastic force of the elastic member, i.e., balance adjustment of biasing force applied to the input gear can be made easily. Therefore, the valve opening-closing timing control apparatus can be made silent.

In the valve opening-closing timing control apparatus according to this disclosure, the elastically deformable portion may include a curved portion whose one end is supported by the supported portion, and a linear portion supported by another end of the curved portion. The supported portion and the linear portion may at least partially overlap with each other when viewed in a radial direction of the eccentric member.

According to the above-described configuration, the elastically deformable portion as the curved portion can be elastically deformed in the radial direction, thereby generating biasing force.

According to the above-described configuration, the curved portion is deformed by reaction force against biasing force in such a way that a curvature radius of a bottom portion of a U-shape becomes smaller, and in a case where the bottom portion of the U-shape is moved in a direction of approaching the eccentric member, when the second concave portion is formed in the first concave portion for example, a part of the bottom portion of the U-shape can be accommodated in the second concave portion. Thereby, the curved portion is allowed to entirely deform, and particularly, partial deformation of the curved portion is prevented, and thus, durability of the elastic member is improved.

In the valve opening-closing timing control apparatus according to this disclosure, the eccentric member may include a second concave portion formed on the bottom surface of the first concave portion. The first concave portion may accommodate the supported portion. The second concave portion may accommodate a part of the curved portion.

According to the above-described configuration, the curved portion can be accommodated in the second concave portion, and thus, a curvature radius of the curved portion can be made larger. Thereby, the curved portion is allowed to entirely deform, and the elastic member can receive a sufficient load by gradual deformation of the entire curved portion. As a result, local deformation of the curved portion is prevented, and thus, durability of the elastic member is improved. Therefore, disturbance of balance of biasing force due to degradation or breakage of the elastic member is prevented, and the valve opening-closing timing control apparatus can be made silent.

In the valve opening-closing timing control apparatus according to this disclosure, the elastic member may be constituted of a pair of spring members. A pair of the spring members may each include the supported portion, the elastically deformable portion, and the biasing portion.

According to the above-described configuration, biasing force can be generated by the two spring members. In this case, both of the spring members are supported by one first concave portion, and for this reason, balance of biasing force applied to the input gear by a pair of the spring members as one-unit elastic member is unlikely to be disturbed. In other words, a variation in biasing force of each of the spring members can be suppressed, and balance of biasing force applied to the input gear by one-unit elastic member can be easily adjusted.

In the valve opening-closing timing control apparatus according to this disclosure, the supported portions may at least partially overlap with each other when viewed in the axial direction of the eccentric axis.

According to the above-described configuration, the input gear can be biased at two different positions in the axial direction and at the two positions same in the circumferential direction. Thereby, the elastic member can be made compact in the circumferential direction of the eccentric member. Further, a variation in biasing force in the circumferential direction can be made smaller.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening-closing timing control apparatus comprising:

a driving-side rotor that rotates around a rotation axis in synchronization with a crankshaft of an internal combustion engine;

a driven-side rotor that is arranged coaxially with the rotation axis and on an inner side of the driving-side rotor and rotates integrally with a camshaft for opening and closing a valve of the internal combustion engine; and a phase adjustment mechanism that sets a relative rotation phase between the driving-side rotor and the driven-side rotor, wherein the phase adjustment mechanism includes:

an output gear that is provided at the driven-side rotor in such a way as to be coaxial with the rotation axis;

an input gear that rotates around an eccentric axis in an orientation parallel to the rotation axis and is connected to the driving-side rotor;

a tubular eccentric member that supports the input gear from an inner circumferential side and allows the input gear to rotate;

a first bearing that is arranged between an inner circumference of the driven-side rotor and an outer circumference of the eccentric member;

a second bearing that is arranged between an inner circumference of the input gear and an outer circumference of the eccentric member and on a side farther from the camshaft than the first bearing in a direction along the rotation axis; and an elastic member that is arranged between an outer circumferential side of the eccentric member and an inner circumferential side of the second bearing and along a circumferential direction of the eccentric member and applies biasing force to the input gear in such a way as to cause a part of the input gear to mesh with a part of the output gear, rotation of the eccentric member causes the eccentric axis to revolve and thereby changes a position where the output gear meshes with the input gear, the eccentric member includes one first concave portion formed on an outer circumferential surface along the circumferential direction, the elastic member includes:

a supported portion that is supported by a bottom surface of the first concave portion;

an elastically deformable portion that is supported by the supported portion and generates the biasing force; and a biasing portion that is supported by the elastically deformable portion and applies the biasing force to the input gear, the elastic member is accommodated in the first concave portion, and is supported by the first concave portion at two different locations in the circumferential direction, the elastic member is constituted of a pair of spring members accommodated in the first concave portion, and the pair of spring members each include the supported portion, the elastically deformable portion, and the biasing portion.

2. The valve opening-closing timing control apparatus according to claim 1, wherein the elastic member applies the biasing force to the input gear at two locations being different from each other in an axial direction of the eccentric axis and overlapping with each other when viewed in the axial direction.

3. The valve opening-closing timing control apparatus according to claim 1, wherein the elastically deformable portion includes:

a curved portion whose one end is supported by the supported portion; and a linear portion supported by another end of the curved portion, and the supported portion and the linear portion at least partially overlap with each other when viewed in a radial direction of the eccentric member.

4. The valve opening-closing timing control apparatus according to claim 3, wherein the eccentric member includes a second concave portion formed on the bottom surface of the first concave portion, the first concave portion accommodates the supported portion, and the second concave portion accommodates a part of the curved portion.

5. The valve opening-closing timing control apparatus according to claim 1, wherein the supported portions at least partially overlap with each other when viewed in an axial direction of the eccentric axis.

* * * * *